US012791285B2

(12) United States Patent
Springer

(10) Patent No.: US 12,791,285 B2
(45) Date of Patent: Nov. 10, 2026

(54) SIGHT FOR PROJECTILE LAUNCHER

(71) Applicant: MSV VENTURES LLC, Rushville, OH (US)

(72) Inventor: Mason Springer, Rushville, OH (US)

(73) Assignee: MSV VENTURES LLC, Rushville, OH (US)

( * ) Notice: Subject to any disclaimer, the term of this patent is extended or adjusted under 35 U.S.C. 154(b) by 90 days.

(21) Appl. No.: 18/405,911

(22) Filed: Jan. 5, 2024

(65) Prior Publication Data

US 2025/0224204 A1 Jul. 10, 2025

(51) Int. Cl.
*F41G 1/467* (2006.01)
*F41G 1/44* (2006.01)

(52) U.S. Cl.
CPC ..... *F41G 1/467* (2013.01); *F41G 1/44* (2013.01)

(58) Field of Classification Search
CPC .... F41G 1/467; F41G 1/44; F41B 5/10; F41B 5/14; F41B 5/143
USPC ..... 33/265; 124/24.1, 87, 25.6
See application file for complete search history.

(56) References Cited

U.S. PATENT DOCUMENTS 1,847,593 A * 3/1932 Colin ..... F41G 1/467 124/24.1
2,814,284 A * 11/1957 Sileo ..... F41B 5/12 124/87
2,909,167 A * 10/1959 Fredrickson ..... F41B 5/143 124/25.7
3,281,940 A * 11/1966 Harrigan ..... F41G 1/467 356/255
3,406,675 A * 10/1968 Fredrickson ..... F41B 5/14 124/25.7
3,715,807 A * 2/1973 Heffer ..... F41G 1/467 33/265
4,587,945 A * 5/1986 Little ..... F41G 1/467 124/87
5,090,805 A * 2/1992 Stawarz ..... F41G 1/467 356/252

(Continued)

FOREIGN PATENT DOCUMENTS

DE 202025000888 U1 * 10/2025 ..... F41G 1/467

OTHER PUBLICATIONS

T.R.U. BALL/AXCEL; https://truball.com/collections/tournament-sights/products/achieve-xp-2-0-vr-uhm-compound-9-lh-rh; Achieve XP 2.0 VR-UHM Compound 9" LH/RH; 5 pages, Downloaded on Aug. 15, 2023.

(Continued)

*Primary Examiner* — Alexander R Niconovich
(74) *Attorney, Agent, or Firm* — Merchant & Gould P.C.

(57) ABSTRACT

A sight apparatus, a projectile launcher apparatus, and a method for launching a projectile are disclosed. The sight for a projectile launcher includes a housing having an upper portion, a lower portion, a front end and a back end, and defining an interior space therein, the lower portion including an open bottom extending between the front end and the back end. The sight for a projectile launcher further includes at least one sight pin having a tip arranged within the interior space of the housing. The sight for a projectile launcher also includes a connecting structure positioned on a first side of the housing, the connecting structure configured to adjustably attach the sight to the projectile launcher.

14 Claims, 9 Drawing Sheets

(56) References Cited

U.S. PATENT DOCUMENTS

| | | | | | |
|---|---|---|---|---|---|
| 5,255,440 | A * | 10/1993 | Rogers | F41G 1/467 | 124/87 |
| 5,413,084 | A * | 5/1995 | Haggard | F41G 1/467 | 124/44.5 |
| 5,419,303 | A * | 5/1995 | Stewart | F41B 5/143 | 124/44.5 |
| 5,524,601 | A * | 6/1996 | Slates | F41B 5/1426 | 124/87 |
| 6,508,005 | B2 * | 1/2003 | Springer | F41G 1/467 | 124/87 |
| 6,560,884 | B1 * | 5/2003 | Afshari | F41G 1/467 | 124/87 |
| 7,100,291 | B2 | 9/2006 | Afshari | | |
| 7,464,477 | B2 * | 12/2008 | Afshari | F41G 1/467 | 124/87 |
| 7,574,810 | B1 * | 8/2009 | LoRocco | F41G 1/44 | 124/87 |
| 7,578,067 | B2 * | 8/2009 | Rager | F41G 1/467 | 33/297 |
| 7,594,335 | B1 * | 9/2009 | Schmitz | F41G 1/467 | 33/265 |
| 8,356,416 | B1 * | 1/2013 | Johnson | F41G 1/467 | 124/87 |
| 9,134,095 | B1 * | 9/2015 | Mills | F41G 1/467 | |
| 10,663,257 | B2 * | 5/2020 | Dale | F41G 1/467 | |
| 10,670,372 | B2 * | 6/2020 | VanCamp | F41G 1/30 | |
| 12,085,363 | B2 * | 9/2024 | Dalton | F41G 1/44 | |
| 2004/0111900 | A1 * | 6/2004 | Rager | F41G 1/467 | 33/265 |
| 2014/0261354 | A1 * | 9/2014 | Ross, Jr. | F41B 5/143 | 124/88 |
| 2024/0159501 | A1 * | 5/2024 | Dalton | F41G 1/467 | |

OTHER PUBLICATIONS

Truball; Achieve XP 2.0 VR-UHM Compound 9" LH/RH; https://truball.com/collections/tournament-sights/products/achieve-xp-2-0-vr-uhm-compound-9-lh-rh; Accessed on Aug. 15, 2023; 5 pages.

* cited by examiner

SIGHT FOR PROJECTILE LAUNCHER

BACKGROUND

A sight for a projectile launcher, such as a firearm, bow, compound bow, or the like, serves as a useful tool in enhancing accuracy by providing a visual aid for aligning the launcher with the target. Sights can range from simple mechanical aids to advanced optical systems. Regardless of the type of projectile launcher, the use of a sight significantly improves the accuracy and effectiveness of the shot.

SUMMARY

A variety of additional inventive aspects will be set forth in the description that follows. The inventive aspects can relate to individual features and to combinations of features. It is to be understood that both the forgoing general description and the following detailed description are exemplary and explanatory only and are not restrictive of the broad inventive concepts upon which the embodiments disclosed herein are based.

In general terms, this disclosure is directed to a sight for a projectile launcher. In some embodiments, the sight for a projectile launcher includes a housing with an upper portion, a lower portion, a front end, and a back end. The housing defines an interior space, and the lower portion has an open bottom that extends from the front end of the housing to the back end of the housing. The sight for a projectile launcher has at least one sight pin with a tip and the at least one sight pin with a tip is arranged within the interior space of the housing. The sight for a projectile launcher also has a connecting structure positioned on a first side of the housing and the connecting structure is configured to adjustably attach the sight to the projectile launcher.

In general terms, this disclosure is also directed to a projectile launcher. In some embodiments, the projectile launcher includes a frame structure configured for attachment to a string and an aiming structure. The aiming structure includes a mounting structure configured for attachment to the frame structure and an archery sight configured for attachment to the mounting structure. The archery sight has a housing with an upper portion, a lower portion, a front end, and a back end. The sight housing defines an interior space, and the lower portion includes an open bottom that extends from the front end of the housing to the back end of the housing. The archery sight also has at least one sight pin with a tip arranged within the interior space of the housing. There is a connecting structure positioned on a first side of the housing and the connecting structure is configured to adjustably attach the archery sight to the mounting structure.

In general terms, this disclosure is also directed to a method for launching a projectile. In some embodiments, the method for launching a projectile includes assuming a shooting position with a projectile launcher, nocking a projectile onto a string, drawing the string to an anchor point, aiming at a target by looking through a peep sight and aligning at least one sight pin of a sight with the target, the sight comprising a housing having an upper portion, a lower portion, a front end and a back end, and defining an interior space therein, the lower portion including an open bottom extending between the front end and the back end, and releasing the string so that the projectile travels through the interior space of the sight on its path to the target.

BRIEF DESCRIPTION OF THE DRAWINGS

The accompanying drawings, which are incorporated in and constitute a part of the description, illustrate several aspects of the present disclosure. A brief description of the drawings is as follows.

DETAILED DESCRIPTION

Figure 1:
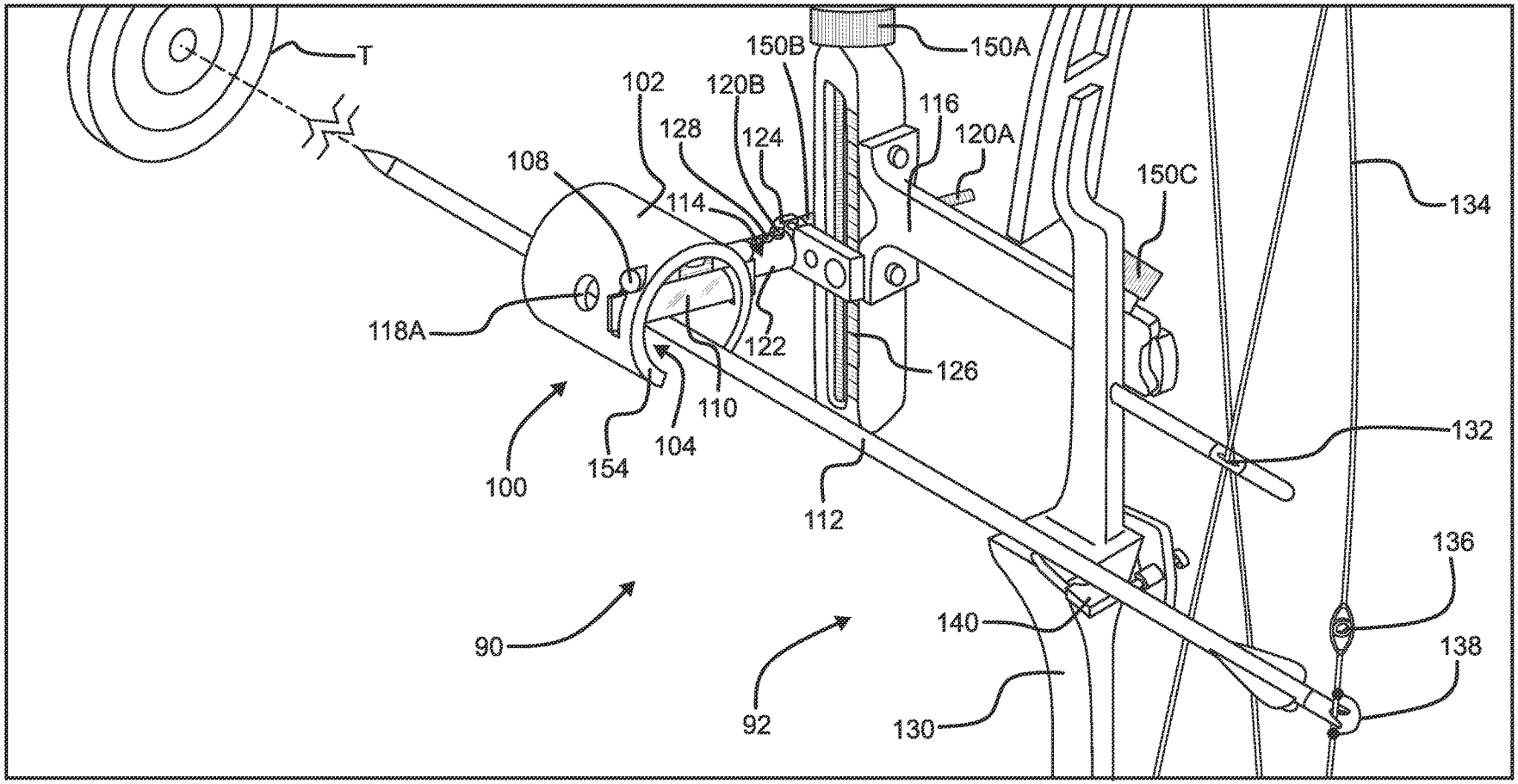
FIG. 1 is a perspective view of a projectile launcher with a sight included, according to an embodiment of the disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

The present disclosure generally provides a sight that increases long range accuracy and effectiveness of a projectile launcher.

Referring to FIG. 1, an embodiment of a sight 100 attached to a projectile launcher 90 is shown in a relaxed position directed towards a target T. Examples of projectile launchers include firearms, bow assemblies, educational assemblies, or toy assemblies. In the embodiment depicted in FIG. 1, the projectile launcher is a bow assembly 92. Various types of bow assemblies 92 include recurve bows, longbows, crossbows, and compound bows.

In the embodiment depicted in FIG. 1, the sight 100 includes a sight housing 102 that defines an interior space 104 within the housing 102. The sight housing 102 may be formed in a substantially cylindrical shape. In another embodiment the sight housing 102 may be substantially oblong in shape. In a particular embodiment, the sight housing may be crescent shaped. In the embodiment depicted in FIG. 1, the sight housing 102 is substantially horseshoe shaped such that it is a tubular form with an open bottom extending entirely along the lower portion of the sight housing 102. Within the interior space 104, a sight pin 106 (not shown) extends from the housing 102 toward the center of the interior space 104 in FIG. 1. In some embodiments, the sight 100 consists of the sight housing 102, that defines an interior space 104, and a sight pin 106. In the depicted example, a level 108 is anchored in the housing 102 and extends across the interior space 104. A mirror 110 is also anchored in the housing 102 closer to the center of the interior space 104 than the level 108. In an alternative embodiment, the level 108 is anchored in the housing closer to the center of the interior space 104 than the mirror 110. Despite the incorporation of both the level 108 and the mirror 110 there is still sufficient clearance in the interior space 104 for an arrow 112 to pass through the interior space 104 of the sight 100.

In the embodiment shown in FIG. 1 the sight 100 is attached to a sight bar 114 that is attached to a mounting structure 116. The term sight bar 114 may be any structure or apparatus configured to attach the sight 100 to either a mounting structure 116 or to a projectile launcher 90 directly. The sight 100 may be configured for attachment to any commercially available sight bar 114. In particular embodiments, the mounting structure 116 may be any commercially available rail system. In other embodiments, the mounting structure 116 may be configured for attachment to any commercially available rail system. In some embodiments, the mounting structure 116 may be configured for attachment to a gear sight system that is configured for attachment to a projectile launcher 90.

As depicted in FIG. 1, the sight bar 114 may be oriented perpendicular to the open bottom of the housing 102. The sight 100 may attach to the sight bar 114 through at least one connecting structure 118 on a side of the housing 102. The at least one connecting structure 118 illustrated in the embodiment depicted in FIG. 1 includes a first connecting structure 118A and a second connecting structure 118B (not visible from the depicted perspective view). In the embodiment illustrated in FIG. 1, the second connecting structure 118B may be located in substantially the same position as 118A but in the opposite side of the housing 102, across the interior space 104 of the housing 102, and in connection with the sight bar 114. By having more than one connecting structure 118 the sight 100 may be used with both right-hand bow assemblies 92 and left-hand bow assemblies 92. The embodiment depicted in FIG. 1 is illustrated as a right-handed bow assembly 92. In other embodiments, the sight 100 may also be used as a left-hand bow assembly 92. In a particular embodiment, the connecting structure 118 is an aperture in a side of the housing 102 that receives a fastening mechanism 120 through a housing 122 of the sight bar 114. In the depicted embodiment the sight bar 114 is adjustably secured into an appendage 124 of the mounting structure 116. In a particular embodiment, the appendage 124 of the mounting structure is a windage block with a securing mechanism. A distance reference 126 may also be attached to the projectile launcher 92. In one embodiment, the distance reference 126 may be attached to the mounting structure 116. In a particular embodiment the distance reference 126 is a sight tape that has marks that correspond to particular distances that permit quick and accurate adjustments.

In some embodiments the connecting structure 118 of the housing 102 may be threaded to receive a complementary threaded fastening mechanism 120. Examples of fastening mechanisms 120 include screws, bolts, rods, and similar devices for coupling that do not necessitate permanent coupling. Fastening mechanisms 120 may be secured in place by a securing mechanism such as a nut or washer. In the embodiment depicted in FIG. 1, there is at least one fastening mechanism, including a first fastening mechanism 120A and a second fastening mechanism 120B. In the FIG. 1 embodiment, the sight bar fastening mechanism 120A may extend through a sight bar housing 122 that is configured for adjustable attachment to the mounting structure 116. In some embodiments the housing of the sight bar 122 may contain a plurality of apertures 128 that can receive a fastening mechanism 120B. The aperture of the sight bar housing 128 that receives a fastening mechanism 120B dictates the distance of the sight 100 from the mounting structure 116 because the fastening mechanism 120B of the sight bar housing 122 should abut the mounting structure 116. By loosening the fastening mechanism 120B in the aperture of the sight bar housing 128 the fastening mechanism 120A attached to the connecting structure 118 of the sight housing 102 may rotate, thereby rotating the sight 100. In an alternate embodiment, the connecting structure 118 of the sight 100 forms a permanent connection between the sight 100 and the mounting structure 116 through the sight bar 114 or between the sight 100 and projectile launcher 90 through the sight bar 114.

As shown in the embodiment depicted in FIG. 1, the mounting structure 116 may attach the sight 100 connected to the sight bar 114 to the projectile launcher 90. The mounting structure 116 may be attached to the projectile launcher 90 along either a fixed, or continuous, plurality of locations such that the sight bar 114 and sight 100 may move along a dimension parallel to the length of the mounting structure 116 depicted in FIG. 1 and perpendicular to the riser 130 depicted in FIG. 1. Moving the sight bar 114 closer to the frame or riser 130 of the bow assembly 92 may increase the maximum projectile aiming distance of a projectile launcher 90 but such an arrangement decreases aiming ability of the projectile launcher 90. In the depicted embodiment shown in FIG. 1, the mounting structure 116 may be attached to the riser 130 of the bow assembly 92 with at least one fastening mechanism 120. In an alternate embodiment, the mounting structure 116 may be attached to a projectile launcher 90 with a dovetail rail mounting system. The mounting structure 116 may be attached to the riser 130 of the bow assembly 92 in a number of locations. In an alternate embodiment, the sight 100 may attach directly to a mounting structure 116 without the need of a sight bar 114. In another alternative embodiment, the sight 100 may attach to the mounting structure 116 or riser 130 by a dovetail rail mount instead of a fastening mechanism.

In the embodiment depicted in FIG. 1, the projectile launcher 90 is a bow assembly 92, specifically a compound bow assembly. An embodiment of one of the various configurations of compound bow assemblies is shown in FIG. 1 where cables 132 are used to transmit force and smooth the process of drawing the shooting string 134. Such a system is particularly beneficial in embodiments where the draw weight of a bow assembly 92 is greater than 15 pounds (6.8 kg). In some embodiments, the draw weight of the bow assembly 92 may be up to 60 pounds (27.2 kg). In other embodiments, the draw weight of the bow assembly 92 may be between 70-80 pounds (31.8-36.3 kg). In another embodiment, the draw weight of the projectile launcher 90 may be between 1-400 pounds (0.4-181.4 kg).

In some embodiments, the bow assembly 92 may have a draw length ranging from 24 inches (61 cm) to 34 inches (86.4 cm). A peep sight 136 may be inserted into the shooting string 134. The arrow 112 may be nocked on the shooting string 134. In the embodiment depicted in FIG. 1, the arrow 112 is nocked within a D-loop 138. The D-loop 138 may be a point of attachment for a release aid. As depicted in FIG. 1 the arrow 112 may be positioned on an arrow rest 140 attached to the riser 130 of the bow assembly 92.

Figure 2:
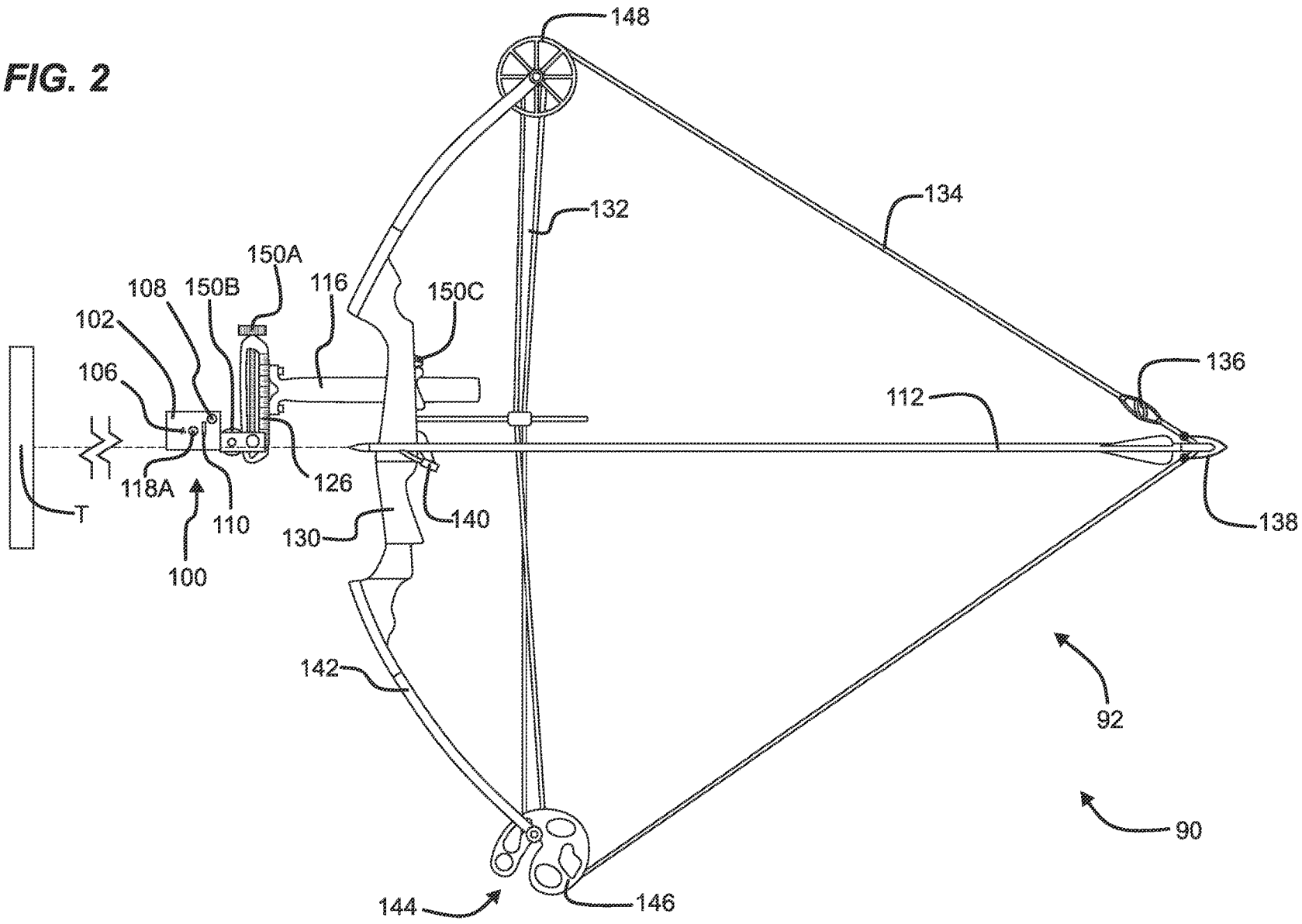
FIG. 2 is a side view of a projectile launcher with a sight included, according to an embodiment of the disclosure.

In an operation of an embodiment, an individual in a shooting stance holds the bow assembly 92 by the riser 130 (which may include a handle or grip portion). The individual places the arrow 112 on the arrow rest 140 and secures the nock of the arrow 112 to the shooting string 134. As the individual draws the shooting string 134 the limbs 142 flex. In the case of a compound bow, the cam system 144 (FIG. 2) of the bow makes the drawing process easier by transferring energy through a system of cables 132 and a cam 146 (FIG. 2). Through this process the load in the shooting string 134 decreases and the load in the cables 132 increases.

FIG. 2 is a side view of the sight 100 on the bow assembly 92 illustrated in FIG. 1. The embodiment depicted in FIG. 2 is a single cam system 144 as the bow assembly 92 has one cam 146 and one idler wheel 148. A cam system 144 may take a variety of forms, such as single cams, dual cams, hybrid cams, or binary cams.

Once the shooting string 134 is drawn to an anchor point, the individual aims the bow assembly 92 by looking through the peep sight 136 and aligning a sight pin 106 of the sight 100 with the desired location on the target T. This sight line (sight dimension) may be a straight line from the individual's eye through the peep sight 136 to the sight pin 106 and the target T. The line of sight to the sight pin 106 is located above where the arrow 112 is resting on the arrow rest 140. When the individual releases the shooting string 134 the arrow 112 leaves the arrow rest 140 and passes through the interior space 104 within the sight housing 102 initially along a line of departure (departure dimension, or shooting dimension), toward the target T.

Figure 3:
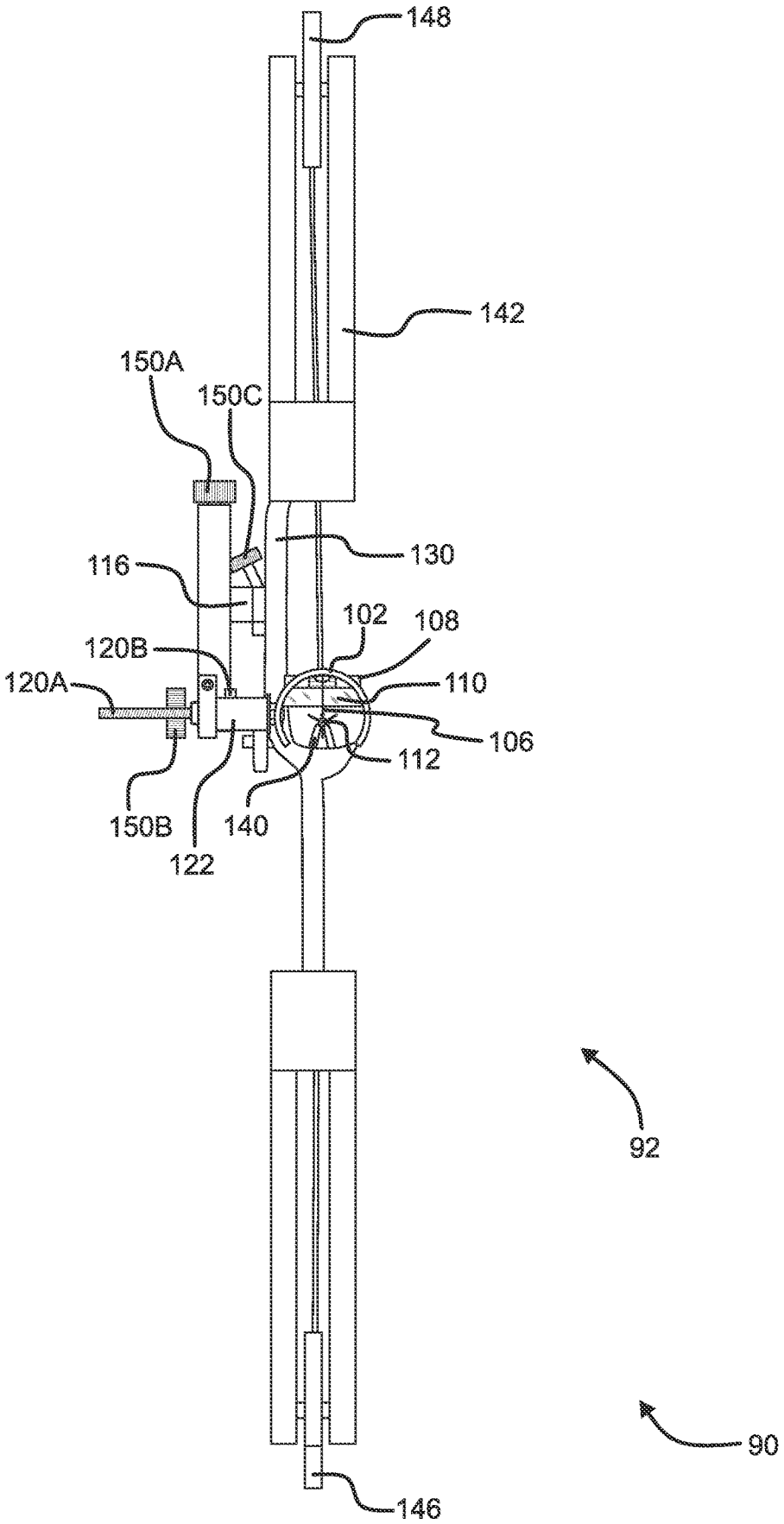
FIG. 3 is a front view of a projectile launcher with a sight included, according to an embodiment of the disclosure.

FIG. 3 is a front view of the projectile launcher 90 with the sight 100 illustrated in FIG. 1 as connected to a bow assembly 92. The mounting structure 116 illustrated in FIG. 3 has at least one adjustment mechanism 150, including a first adjustment mechanism 150A, a second adjustment mechanism 150B, and a third adjustment mechanism 150C. In the embodiment depicted in FIG. 3, there is a first adjustment mechanism 150A (elevation adjustment) that moves the sight 100 up and down a vertical dimension perpendicular to the sight bar housing 122 (first dimension) and a second adjustment mechanism 150B (lateral adjustment) that moves the sight 100 left and right on a horizontal dimension parallel to the sight bar housing 122 (second dimension).

As depicted in the embodiment illustrated in FIG. 3, there is a horizontal dimension extending parallel to the length of the arrow 112 positioned on the arrow rest 140 (third dimension). In some embodiments, there is a third adjustment mechanism 150C (third dimension adjustment) that moves the sight 100 closer to the arrow rest 140 or further from the arrow rest 140. In some embodiments, adjustments along the third dimension may be beneficial when, for example, the projectile is to be launched from an angle.

Elevation adjustment of the sight 100 along the vertical dimension perpendicular to the sight bar housing 122 is beneficial as the sight 100 should generally be positioned at higher elevation positions for targets at shorter distances, such as 20 yards (18.3 meters). The sight 100 should generally be positioned at lower elevation positions for targets at longer distances, such as 55 yards (50.3 meters). Different distance adjustments may be made for different situations. For example, at ultra short distances, such as 3 yards (2.7 meters), the aiming approach is reversed from the one previously described. In this situation, when the target T is at 3 yards (2.7 meters) the sight 100 may be placed at an elevation position used for shooting at 45 yards (41.15 meters).

Lateral adjustment of the sight 100 along the horizontal dimension parallel to the sight bar housing 122 may be beneficial to adjust for wind conditions. In the depicted embodiment, the adjustment mechanisms 150 are illustrated as knobs but an adjustment mechanism 150 may constitute other structures for adjustment along a continuum such as levers, gears, or a lockable slide system. Adjustments along the indicated dimension are not limited to control by a single adjustment mechanism 150 and instead may be controlled by multiple adjustment mechanisms 150. In an example of such an embodiment, one adjustment mechanism 150 may be used to make large adjustments while a second adjustment mechanism 150 may be used to make small adjustments.

Figure 4:
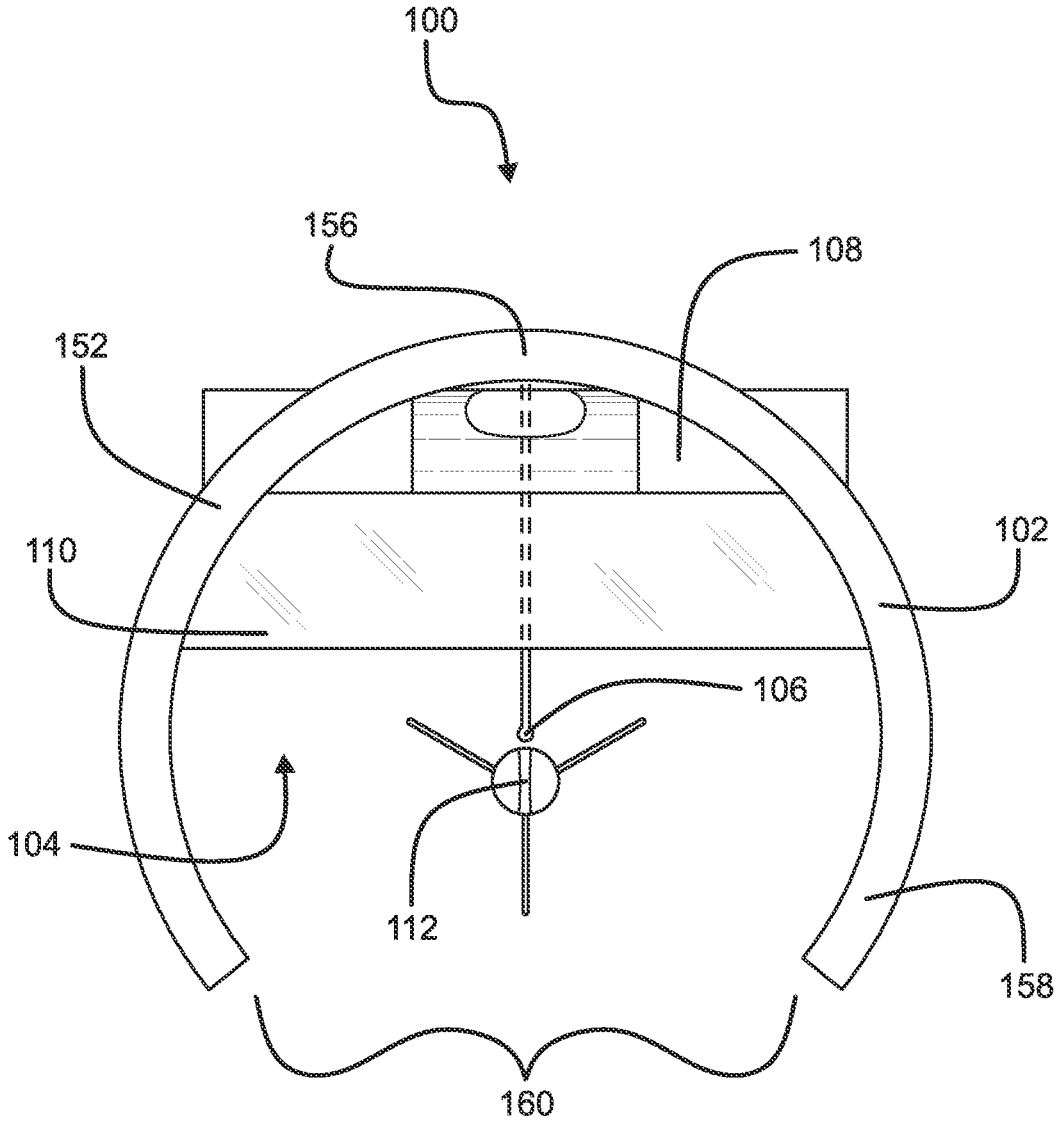
FIG. 4 is a front view of a sight, according to an embodiment of the disclosure.

FIG. 4 is a front view of the embodiment of the sight 100 illustrated in FIG. 1. In the depicted embodiment, the sight housing 102 consists of a front end 152, a back end 154 (not visible), an upper portion 156, a lower portion 158, and an open bottom 160. In a particular embodiment, the front end 152 of the housing 102 may be the end of the housing 102 that is closer to the riser 130 of the bow assembly 92. In some embodiments, the shape of the housing defines an interior space 104. In the embodiment depicted in FIG. 4, the sight housing 102 is a cylindrical, tubular shape but the sight housing 102 may take a plurality of forms that define an interior space 104 that is not entirely encased by the housing 102. In a particular embodiment, the diameter of the housing is about 1.38 inches (35 mm).

In the illustration of the embodiment depicted in FIG. 4, the open bottom 160 of the housing 102 allows the arrow 112 to be positioned closer to the at least one sight pin 106 than if the housing 102 were entirely circular, without an opening. In some embodiments the housing 102 has a unitary construction, such that it may be formed from only one material. In another embodiment, the housing 102 may be formed from multiple materials. In other embodiments, the housing 102 may be formed from multiple components. In some embodiments, the dimensions of the sight housing 102 may correspond to the diameter of a peep sight 136.

As shown in the embodiment illustrated in FIG. 4, the open bottom 160 of the housing allows an arrow 112 to be positioned below the sight pin 106 and to extend through the interior space 104. In a particular embodiment, the open bottom 160 of the housing allows additional clearance of between ⅛th of an inch (0.3 cm) to 2 inches (5.1 cm) from the tip of the sight pin 106 to the housing 102 for the arrow 112 to pass through the interior space 104 of the housing. In some embodiments, the clearance may be 1 inch (2.5 cm). In other embodiments, the clearance may be ¾th of an inch (1.9 cm). A dimension extends parallelly to the orientation of the length of the arrow 112 depicted in FIG. 4, forming a line of departure (departure dimension) along which an arrow 112 may pass through the interior space 104 of the sight 100 from the front end 152 of the housing and out of the back end 154 of the housing when an arrow 112 is launched from a bow assembly 92. In some embodiments, the sight 100 consists of a housing 102, defining an interior space 104 and with an open bottom 160, configured for attachment to a projectile launcher 90 and at least one sight pin 106. Different configurations of the interior space 104, housing 102, sight pin 106, level 108, and mirror 110, exist in various embodiments, but each embodiment may have an interior space 104 configured to accommodate the positioning of a projectile within, or extending through, the interior space 104. In some embodiments, the interior space 104 may be sized to permit the passage of the drag mechanism, such as the vanes, of an arrow 112. In other embodiments, the interior space 104 extends about the line of departure (departure dimension).

As depicted in the embodiment shown in FIG. 4, a sight pin 106 extends from the upper portion 156 of the housing 102 towards the lower portion 158 of the housing 102 into the interior space 104 in the center of the housing 102. The sight pin 106 may be positioned at the midpoint between the front end 152 of the housing 102 and the back end 154 of the housing 102. In a particular embodiment, the front end 152 of the housing 102 may be the side that is oriented toward the shooting string 134 and the riser 130. In another embodiment, the back end 154 of the housing 102 may be the side that is oriented toward the target T. In another embodiment, the sight pin 106 horizontally extends from the housing 102 to the center of the interior space 104. In other embodiments, the sight pin 106 diagonally extends from the housing 102 to the center of the interior space 104. In some embodiments, the sight pin 106 is in a fixed position. In other embodiments, the sight pin 106 is movable to different positions. A distance reference 126 may be used to mark different positions for the sight pin 106 indicating different aiming distances.

In some embodiments, the sight pin 106 is colored. In other embodiments, the sight pin 106 is fiber-optic. In one embodiment, the brightness of the sight pin 106 is controlled by a rheostat fiber ring configured for use with the sight 100 such that increasing the amount of uncovered, exposed fiber increases the sight pin 106 brightness and decreasing the amount of uncovered, exposed fiber decreases the sight pin 106 brightness. The fiber optic sight pin 106 may also be electrically powered. In a particular embodiment, the sight pin 106 is illuminated. In some embodiments, the illumination may be provided by a rheostat sight light.

The sight pin 106 may be fixed in place or it may be movable. In other embodiments, there may be more than one sight pin 106 extending from the housing 102 toward the center of the interior space 104. Smaller sight pins 106 may increase accuracy and larger sight pins 106 may increase visibility. In some embodiments, the sight pin 106 has a diameter of 0.010 inches (0.0254 cm), 0.019 inches (0.04826 cm), or 0.029 inches (0.07366 cm).

As illustrated in the FIG. 4 embodiment, the sight 100 may also have a level 108 and a mirror 110 attached to the sight housing 102. Either, or both, of these components may be used in the alignment of the projectile launcher 90. In one embodiment, an individual may determine if the bow assembly 92 is balanced and being held without unintended lateral tilt by centering the bubble in the level 108. In another embodiment, an individual may use the mirror to ensure that there is not lateral or horizontal tilt by checking that their eye is directly aligned with a reference point for proper alignment, such as above the sight pin 106 in the center of the mirror 110 at a certain mark.

Figure 5:
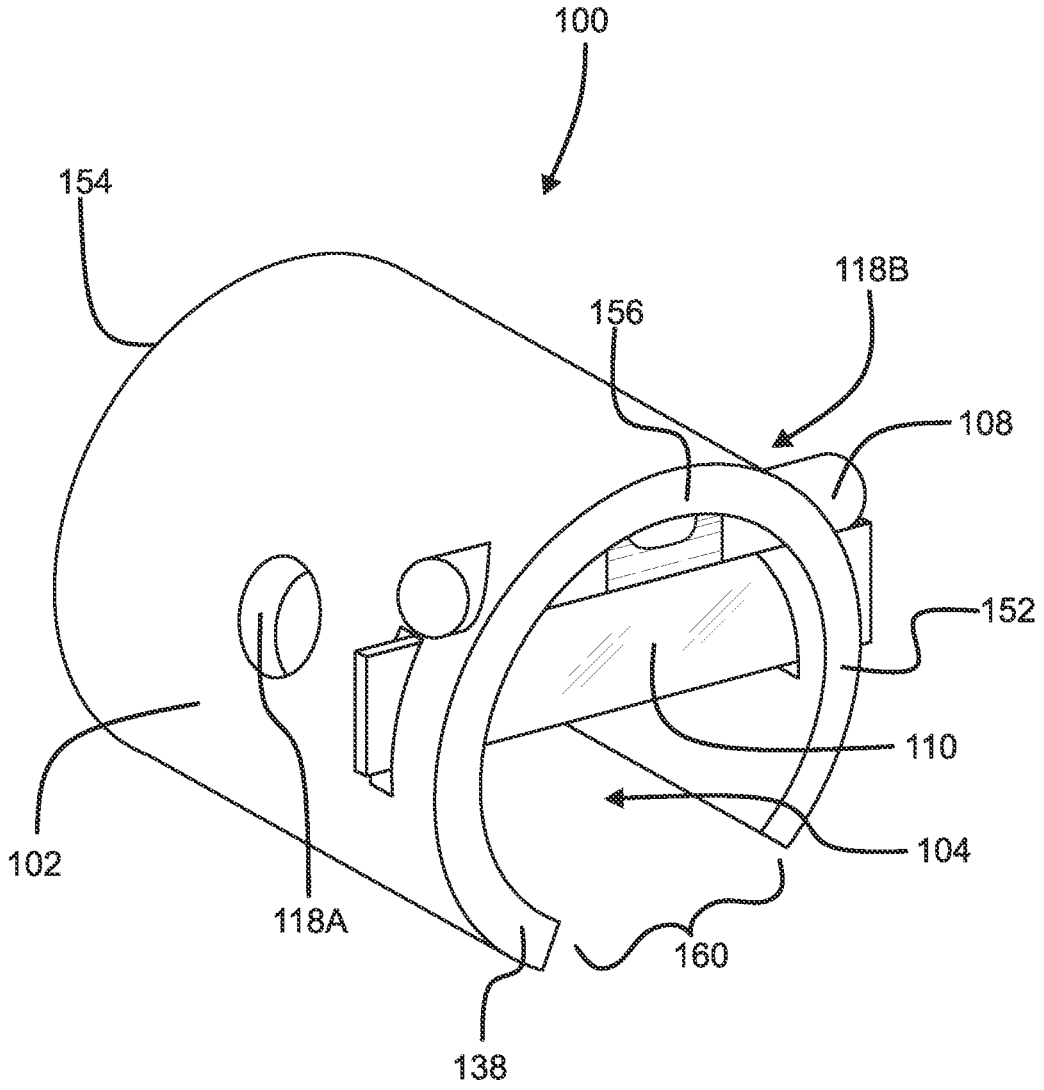
FIG. 5 is a perspective view of a sight, according to an embodiment of the disclosure.

FIG. 5 is a prospective view of the sight 100 illustrated in FIG. 1. In a particular embodiment, the housing 102 has at least one connecting structure 118A positioned substantially between the upper portion 156 and the lower portion 158 of the housing 102 that is configured to adjustably attach the sight 100 to the projectile launcher 90. In some embodiments, the at least one connecting structure 118A is an aperture in a side of the housing 102 that receives a fastening mechanism 120 through a housing 122 of the sight bar 114. In a particular embodiment, the at least one connecting structure 118A may be an aperture that is threaded. In an embodiment, the sight 100 may have only one connecting structure 118. In some embodiments, the sight 100 may have more than one connecting structure 118. In one of those embodiments, there may be a first connecting structure 118A positioned between the upper portion 156 and the lower portion 158 of the housing 102 on one side of the housing substantially perpendicular to the level 108 and there may be a second connecting structure 118B positioned between the upper portion 156 and the lower portion 158 of the housing 102 on the second side of the housing 102 substantially perpendicular to the level 108. By having a connecting structure 118 on either side of the housing 102 substantially perpendicular to the level 108 the sight 100 may be configured for attachment to either a right-hand bow assembly 92 or a left-hand bow assembly 92.

Figure 6:
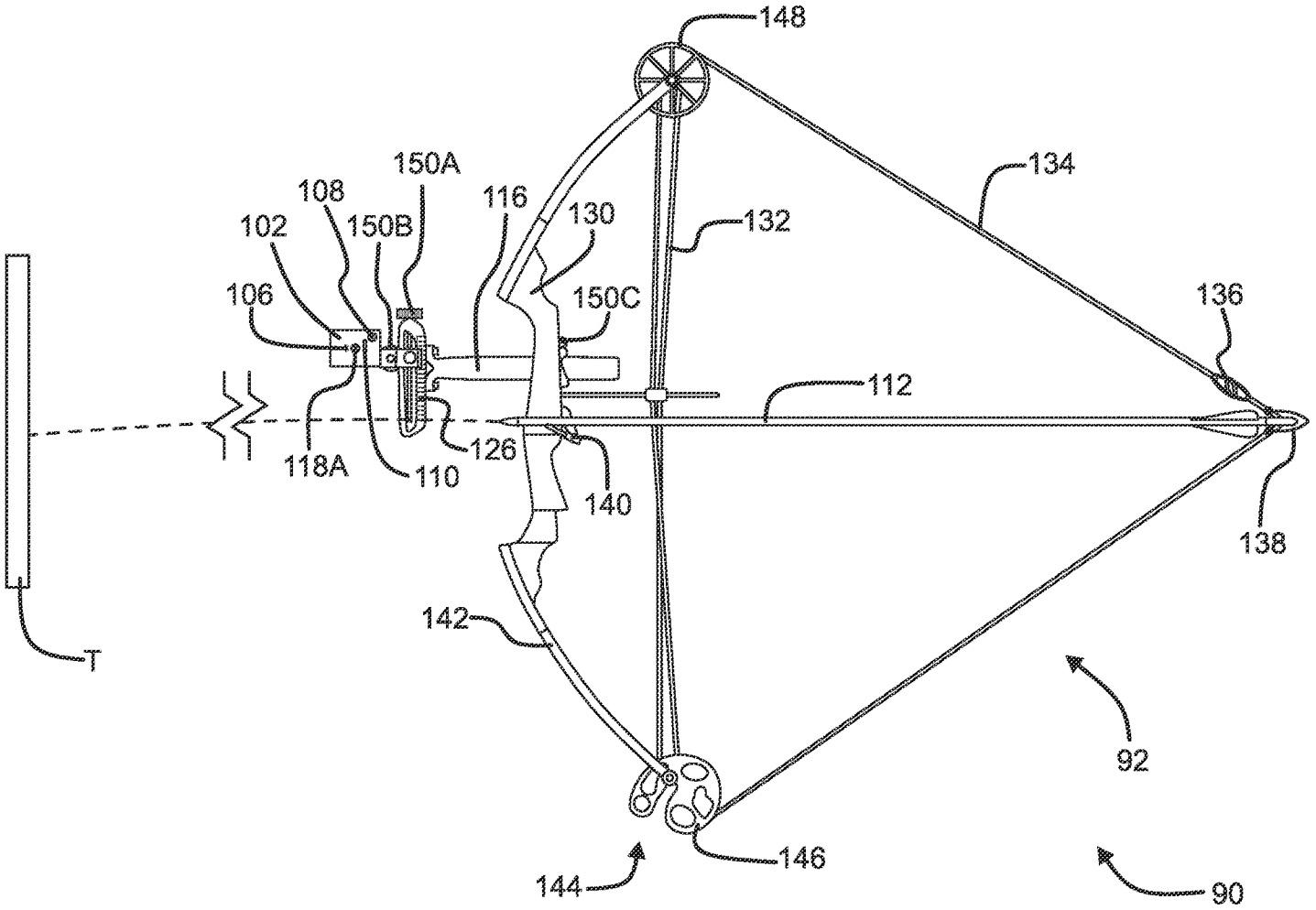
FIG. 6 is a side view of a projectile launcher with a sight included, according to an embodiment of the disclosure.
Figure 7:
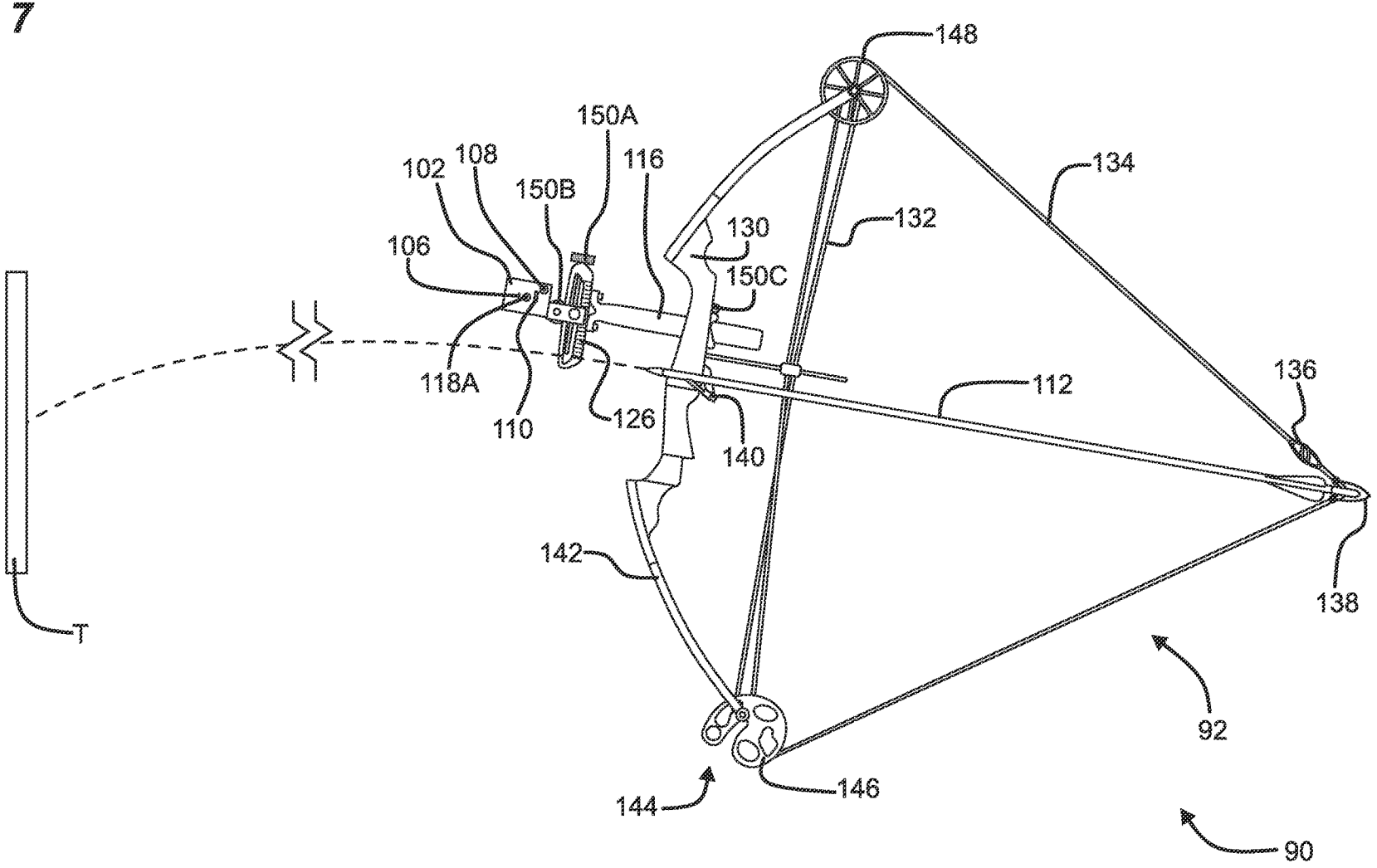
FIG. 7 is a side view of a projectile launcher with a sight included, according to an embodiment of the disclosure.
Figure 8:
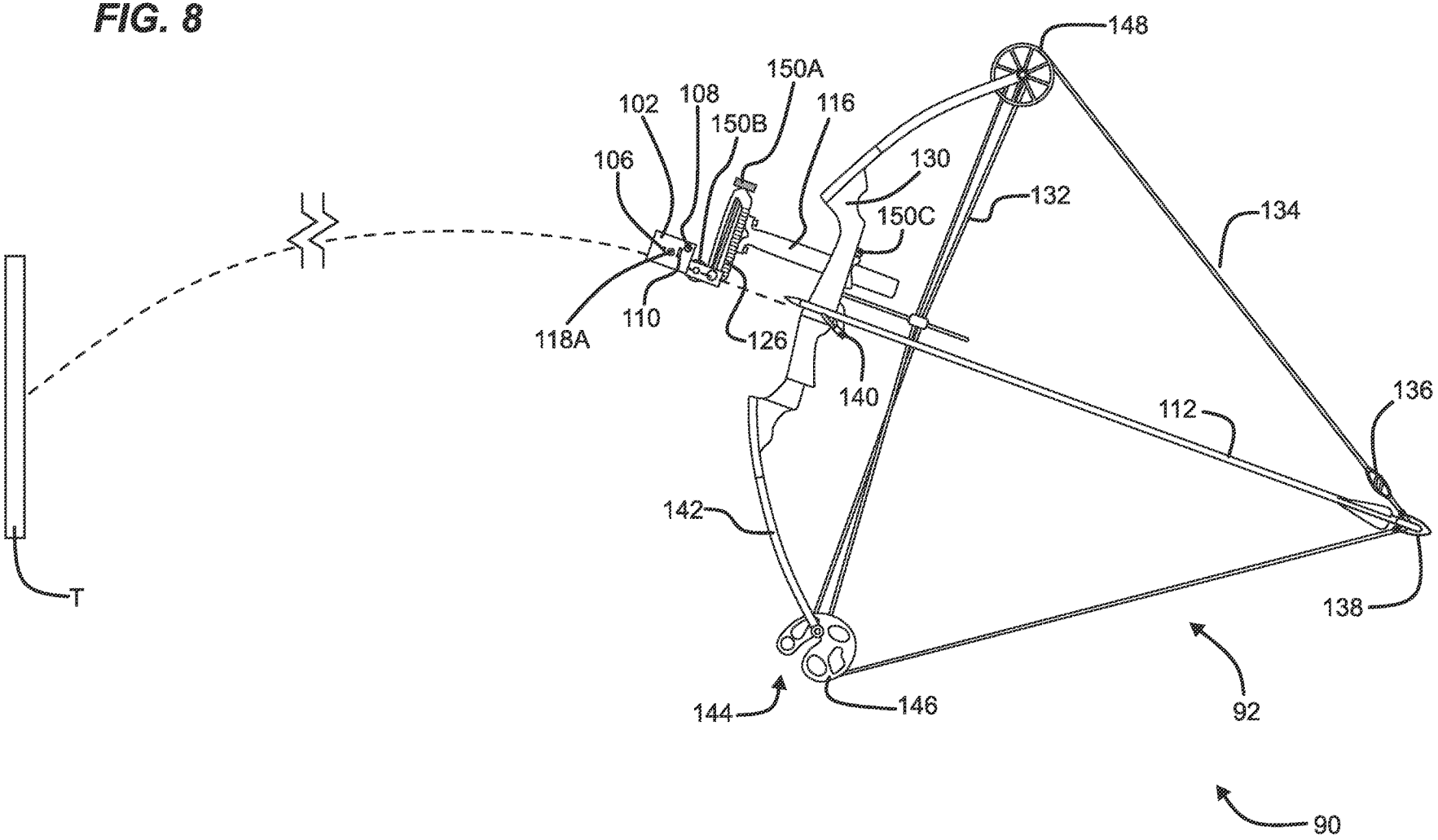
FIG. 8 is a side view of a projectile launcher with a sight included, according to an embodiment of the disclosure.

FIGS. 6-8 depict side views of a projectile launcher 90, depicted as a bow assembly 92, with the sight 100 illustrated in FIG. 1 in a drawn position directed toward a target T at locations of increasing distance. In the embodiment depicted in FIG. 6, the projectile launcher 90 is aimed at the target T at a distance of approximately 20 yards (18.29 meters). In the embodiment depicted in FIG. 7, the projectile launcher 90 is aimed at the target T at a distance of approximately 60 yards (54.86 meters). In the embodiment depicted in FIG. 8, the projectile launcher 90 is aimed at the target T at a distance of approximately 100 yards (91.44 meters).

In FIG. 6, the target T is located at the closest distance of FIGS. 6-8. As shown in FIG. 6, when a bow assembly 92 is aimed at a shorter range (exclusive of ultra close range distances such as 3 yards (2.7 meters)) the sight 100 is positioned at an elevation near the top of the mounting structure 116. The inverse relationship for longer distances between the distance of a target and the vertical elevation position of the sight 100 in reference to the mounting structure 116 is depicted in FIGS. 6-8. As the distance of the target T increases, as shown in FIGS. 7 and 8, the sight 100 is positioned at decreasing elevation locations relative to the mounting structure 116.

This inverse relationship creates an issue for aiming projectiles with a projectile launcher 90. Reduced to a simple explanation, when a projectile is launched there are three considerations for aiming: the line of sight (sight dimension), the line of departure of the projectile (departure dimension), and the trajectory of the projectile. In the embodiment depicted in FIG. 6, the line of sight would be a straight line extending from the eye of an individual (not shown) through the peep sight 136 to the sight pin 106 in the sight 100 that is focused on a location on the target T. In the embodiment illustrated in FIG. 6, the line of departure of the projectile is straight line extending from the tip of the arrow 112 towards the target T.

Unlike the line of sight and the line of departure, the trajectory of the projectile is not a straight line. As a projectile is launched the force of gravity causes the trajectory path of the projectile to curve away from the straight path of the line of departure toward the ground. The farther the distance the more curvature to the trajectory. To account for this curvature or drop, individuals create an angle between the line of departure and the line of sight so that the projectile drops to intersect with the line of sight at the desired location. The angle between the line of sight and the line of departure can be created by positioning the line of departure of the projectile at an elevation angle. In some embodiments where the projectile launcher 90 is a bow assembly 92, an individual can tilt the vertical dimension that extends in parallel with the riser 130 such that the arrow 112 is positioned upwards away from the ground.

In situations where the target is at a close distance the flight path of the projectile is shorter which results in less downward curvature of the path of trajectory. Conversely, projectiles aimed at targets at longer distances have a longer flight path which results in more downward curvature of the path of trajectory. To account for the difference in projectile drop, individuals increase the tilt of the line of departure corresponding to increase in distance. In order to accommodate the increased tilt, the sight is lowered in elevation relative to the mounting structure 116 such that the line of sight is maintained. FIGS. 6-8 depict examples of different tilt angles of the projectile launcher 90, to accurately aim at target T. FIGS. 6-8 are exaggerated depictions of the depiction of the orientation of the bow assembly 92 to highlight the differences that may not be readily apparent in a real-world scenario.

As depicted in the embodiments of FIGS. 7 and 8, in addition to the tilt of the of the bow assembly 92, accurate aiming at long distance requires moving the sight 100 to a lower elevation position on the mounting structure 116. As shown in the embodiment depicted in FIG. 7, when the target T reaches a certain distance the line of departure and trajectory path of the arrow 112 are in alignment with the sight 100. In a conventional sight (not shown) this alignment forecloses aiming at long distances because the arrow 112 does not have sufficient clearance to avoid contacting the sight housing 102. In the embodiment depicted in FIG. 8, the arrow 112 may be aimed at a long distance, such as 100 yards, because the interior space 104 within the sight housing and the open bottom 160 of the sight housing allow the passage of an arrow 112 through the lower portion of the sight 100.

Figure 9:
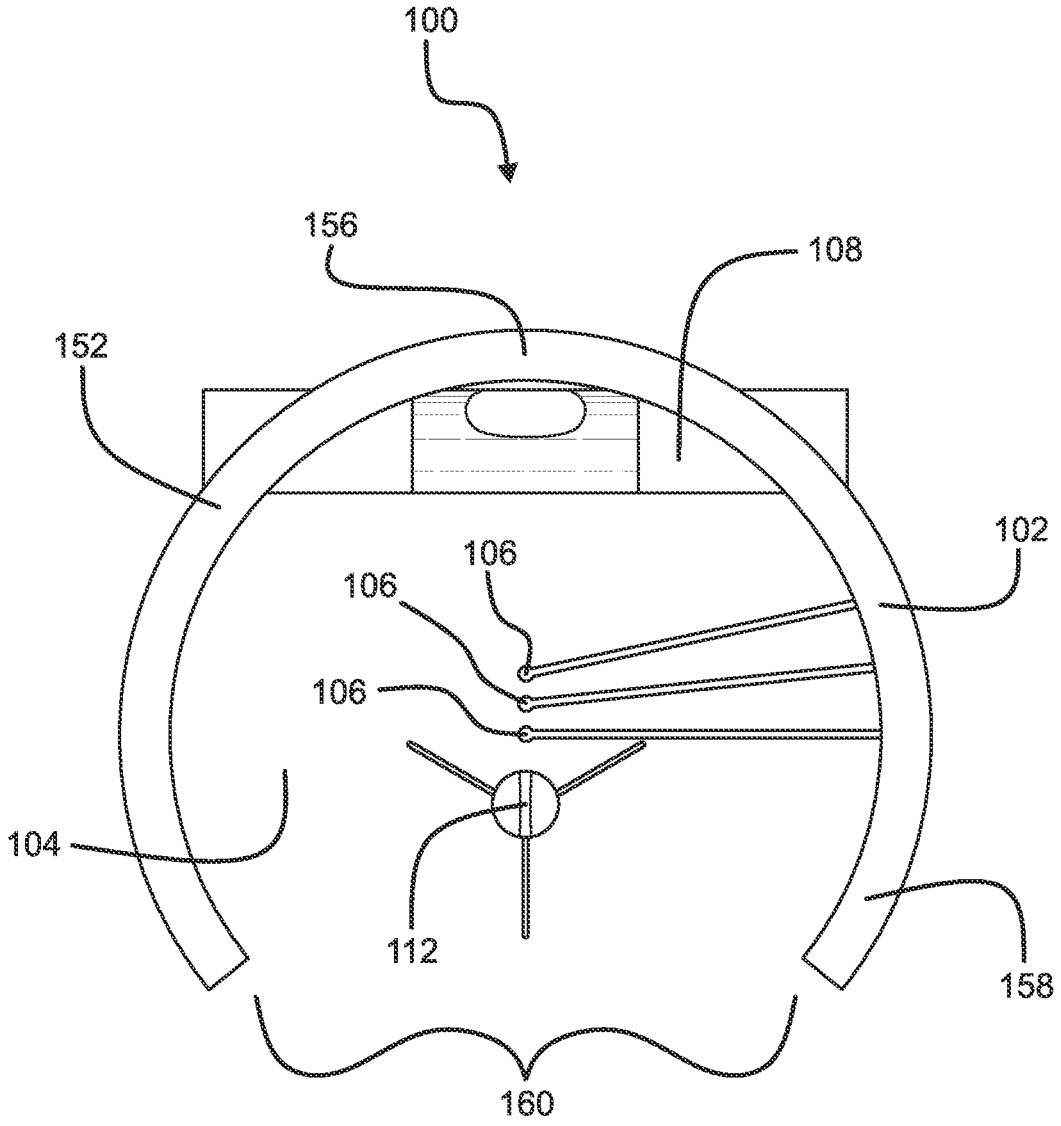
FIG. 9 is a front view of a sight, according to an embodiment of the disclosure.

FIG. 9 is a front view of a different embodiment of the sight 100 illustrated in FIG. 1. As shown in the embodiment depicted in FIG. 9, the sight 100 may have more than one sight pin 106. A wire may be used to aid in the alignment of the more than one sight pins 106. In some embodiments, the sight 100 may include at least one neon or brightly colored partial ring to provide visual contrast to aid in aiming. For example, in such an embodiment the front end 152 of the housing 102 may be colored. In some embodiments the housing 102 functions as a sunshade. In particular embodiments, the sight 100 may be configured for attachments, for example, the sight 100 may be configured for attachment to a sunshade. In other embodiments, the sight 100 is configured for attachment to at least one lens. In one such embodiment, the attached lens may be an illuminated lens.

The various embodiments described above are provided by way of illustration only and should not be construed to limit the claims attached hereto. Those skilled in the art will readily recognize various modifications and changes that may be made without following the example embodiments and applications illustrated and described herein, and without departing from the full scope of the following claims.

What is claimed is:

1. A sight for a projectile launcher comprising:

a housing having an upper portion, a lower portion, a front end and a back end, and defining an interior space therein, the lower portion including an open bottom extending between the front end and the back end;

at least one sight pin having a tip arranged within the interior space of the housing, the tip being centered between the front end and the back end of the housing;

a first connecting structure positioned on a first side of the housing, the connecting structure configured to adjustably attach the sight to the projectile launcher; and a second connecting structure positioned on a second side of the housing, opposite the first side, the second connecting structure configured to connect the sight to the projectile launcher, the first and second connecting structures enabling the sight to be mounted on opposite sides of the projectile launcher;

wherein the upper portion of the housing is a sunshade blocking direct sunlight from reaching the tip of the at least one sight pin, wherein the front end of the housing defines a brightly colored partial ring, wherein the sight further comprises a mirror anchored to the housing and extending laterally across the housing above the tip of the at least one sight pin.

2. The sight of claim 1, wherein the open bottom is configured to allow passage of an arrow from the front end through the back end of the housing forming a shooting dimension along which the arrow can be positioned within the interior space.

3. The sight of claim 2, wherein the interior space extends about the shooting dimension.

4. The sight of claim 2, wherein the interior space is sized to enable a drag mechanism of an arrow to pass through it.

5. The sight of claim 1, wherein the interior space is configured to provide clearance for an arrow.

6. The sight of claim 1, wherein the at least one sight pin extends from the upper portion of the housing toward the lower portion of the housing and terminates at a free end situated in the interior space.

7. The sight of claim 1, wherein the at least one sight pin is positioned at an intermediate distance between the front end and the back end of the housing.

8. The sight of claim 1, wherein the housing is a substantially tubular shape extending between the front end and the back end of the housing.

9. The sight of claim 1, where in the sight further comprises a level attached to the upper portion of the housing.

10. The sight of claim 1, wherein the at least one sight pin is illuminated.

11. The sight of claim 1, wherein the at least one sight pin is a fiber optic pin.

12. A method for launching a projectile using the sight of claim 1, the method comprising:

assuming a shooting position with a projectile launcher having the sight mounted thereon;

nocking a projectile onto a string;

drawing the string to an anchor point;

aiming at a target by looking through a peep sight and aligning the at least one sight pin of the sight with the target; and releasing the string so that the projectile travels through the interior space of the sight on its path to the target.

13. A projectile launcher comprising:

a frame structure configured for attachment to a string; and an aiming structure including a mounting structure and an archery sight configured for attachment to the mounting structure, the mounting structure configured for attachment to the frame structure, the archery sight comprising:

a housing having an upper portion, a lower portion, a front end, and a back end, and defining an interior space therein, the lower portion including an open bottom extending between the front end and the back end;

at least one sight pin having a tip arranged within the interior space of the housing, the tip being centered between the front end and the back end of the housing;

a mirror anchored to the housing and extending laterally across the housing above the tip of the at least one sight pin; and a connecting structure positioned on a first side of the housing, the connecting structure configured to adjustably attach the archery sight to the mounting structure;

wherein the upper portion of the housing is a sunshade blocking direct sunlight from reaching the tip of the at least one sight pin.

14. The projectile launcher of claim 13, wherein the open bottom is configured to allow passage of an arrow from the front end through the back end of the housing forming a shooting dimension along which the arrow can be positioned within the interior space.

* * * * *